United States Patent [19]

Philippson

[11] Patent Number: 4,703,991

[45] Date of Patent: Nov. 3, 1987

[54] LOW PROFILE JACK

[75] Inventor: Walter M. Philippson, Woodside, N.Y.

[73] Assignee: Stewart Stamping Corporation, Yonkers, N.Y.

[21] Appl. No.: 817,816

[22] Filed: Jan. 10, 1986

[51] Int. Cl.[4] ..... H01R 13/10

[52] U.S. Cl. ..... 439/676; 439/76; 439/752

[58] Field of Search ..... 339/17 C, 17 LC, 176 R, 339/176 M, 206 R, 206 P, 207, 209, 210 R, 210 M

[56] References Cited

U.S. PATENT DOCUMENTS

| | | | |
|---|---|---|---|
| 4,050,769 | 9/1977 | Ammon | 339/210 M |
| 4,497,526 | 2/1985 | Myers | 339/17 LC |
| 4,501,464 | 2/1985 | Bogese, II | 339/17 C |

*Primary Examiner*—Joseph H. McGlynn
*Attorney, Agent, or Firm*—Steinberg & Raskin

[57] ABSTRACT

A jack for modular plugs adapted for connection to printed circuit boards. The jack includes a plurality of jack contacts and a two-part housing, the contacts and housing parts being constructed so that the contacts are preferably completely enclosed within the housing with the jack at the same time having a low profile, i.e., a small height dimension.

17 Claims, 17 Drawing Figures

LOW PROFILE JACK

BACKGROUND OF THE INVENTION

The present invention relates generally to jacks for use in electrical connectors and, more particularly, to jacks for modular plugs adapted for connection to printed circuit boards.

The termination of multi-conductor cord by modular plugs has become commonplace. Examples of such modular plugs are disclosed in various patents, such as U.S. Pat. Nos. 3,699,498, 3,761,869, 3,860,316 and 3,954,320. Another advantageous configuration of a modular plug is disclosed in U.S. Pat. No. 4,211,662 assigned to Stewart Stamping Corporation, assignee of the instant application. Essentially, the modular plug includes a dielectric housing having a cavity into which an end portion of the cord is received. Flat contact terminals corresponding in number to the number of cord conductors are inserted into respective slots which open at one housing side and which are aligned with the conductors so that blade-like portions of the contact terminals pierce respective cord conductors. Straight upper edges of the contact terminals are exposed at the side of the housing in position for engagement by respective jack contacts when the modular plug is inserted into the jack.

It is becoming more commonplace to connect the conductors of multi-conductor cords to the conductors of printed circuit boards, such as in computers, through the use of modular plugs. Accordingly, jacks for modular plugs have been designed specifically for connection to printed circuit boards.

However, the applicability of modular plug-jack connectors to printed circuit board connections, such as in computers, has in the past been limited by the geometry of the electronic equipment and conventional plugs and jacks. Computers often include components consisting of a plurality of printed circuit boards stacked one over the other in closely spaced overlying relationship. For example, a computer may have printed circuit boards stacked one over the other with adjacent boards being spaced only slightly more than one-half inch from each other. Since the height of conventional modular plugs is already about ⅜ inch, their use in environments of the type described above, keeping in mind the necessity of providing a jack for receiving the plug, is clearly limited.

Jacks for modular plugs have been designed which enable the use of the modular plugs in the limited available spaces of the type described above. Such jacks are designed with low profiles, i.e., with height dimensions of about one-half inch. Conventional jacks of this type, such as those available from Virginia Plastics Company of Roanoke, Va., generally comprise a one-piece plastic housing having a longitudinal cavity adapted to receive the modular plug. Associated with the housing are a plurality of jack contacts adapted to engage the straight edges of the contact terminals of the plug when the latter is inserted into the jack receptacle. Each jack contact is held by slots or grooves formed in the jack housing and includes a portion which extends along the outside of the rear housing wall and projects below the bottom of the jack housing for insertion into the printed circuit board and a portion which extends along the outside of the top wall through a slot formed therethrough into the jack receptacle for engagement with the edge of a respective contact terminal of the plug.

Jacks of this type are not entirely satisfactory for several reasons. For example, the jack contacts are exposed externally of the jack both at the rear as well as at the top wall thereof thus subjecting the contacts to possible damage during use. Portions of the jack contacts tend to be pushed out or become loosened from the slots or grooves which hold them in place. Furthermore, the jack contacts do not provide sufficient contact pressure against the plug contacts when the plug is inserted into the jack to ensure a reliable electrical connection.

Jacks for modular plugs adapted for connection to printed circuit boards are disclosed in U.S. Pat. No. 4,537,459 and co-pending applications Ser. Nos. 612,722, 655,696, and 806,679 assigned to the assignee of the instant application All of these jacks provide means for EMI/RFI shielding. However, not all of these jacks satisfy the height requirements for use in applications of the types described above and the construction of such jacks is somewhat complicated.

SUMMARY OF THE INVENTION

Accordingly, it is an object of the present invention to provide new and improved jacks for modular plugs adapted for connection to printed circuit boards.

Another object of the present invention is to provide new and improved jacks for modular plugs adapted for connection to printed circuit boards which overcome the disadvantages of conventional jacks.

Still another object of the present invention is to provide new and improved jacks for modular plugs which have such low profiles as to permit connection to printed circuit boards in very limited spaces.

A further object of the present invention is to provide new and improved low profile jacks for modular plugs adapted for connection to printed circuit boards wherein the jack contacts are completely enclosed within the jack housing.

A still further object of the present invention is to provide new and improved low profile jacks for modular plugs adapted for connection to printed circuit boards wherein the jack contacts are completely enclosed within the jack housing and wherein the jack has a simple construction and wherein reliable electrical connection to the modular plug is ensured.

Briefly, in accordance with the present invention, these and other objects are obtained by providing a jack including a plurality of jack contacts and a two-part housing, and housing parts being constructed so that the jack has a low profile, i.e., a small height dimension. In the illustrated embodiment, the jack has a height dimension of about one-half inch.

The jack housing comprises two parts adapted to lockingly interfit with each other preferably such that specially designed jack contacts are captured between them completely enclosed within the housing and precisely located to engage corresponding plug contacts when the modular plug is inserted into the jack. The jack contacts are designed so as to be bendable into appropriate form with a minimal bend radius to facilitate the low profile construction of the jack while at the same time providing sufficient strength to ensure a high contact pressure between the jack and plug contacts.

DETAILED DESCRIPTION OF THE DRAWINGS

A more complete appreciation of the present invention and many of the attendant advantages thereof will be readily understood by reference to the following detailed description when considered in connection with the accompanying drawings in which.

DESCRIPTION OF THE PREFERRED EMBODIMENTS

Figure 1:
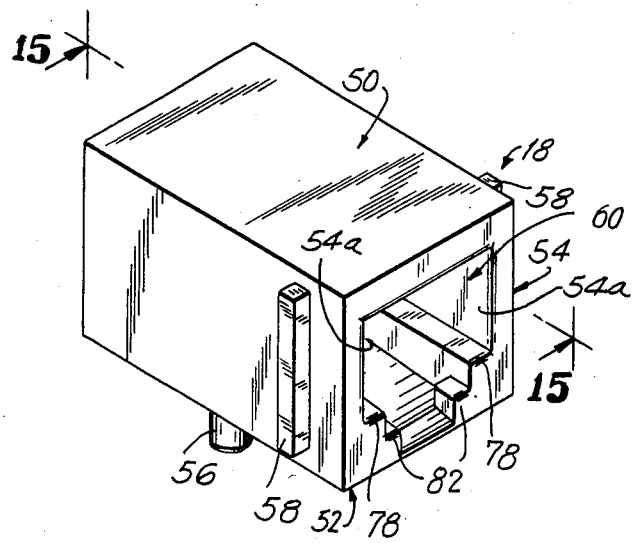
FIG. 1 is a perspective view of a jack in accordance with the present invention.

Referring now to the drawings wherein like reference characters designate identical or corresponding parts throughout the several views, a jack in accordance with the present invention, generally designated 10, is constructed of a plurality of jack contacts 12 and a jack housing 14 formed of a first inner housing part 16 (FIGS. 6–10) and a second outer housing part 18 (FIGS. 11–14).

Figure 2:
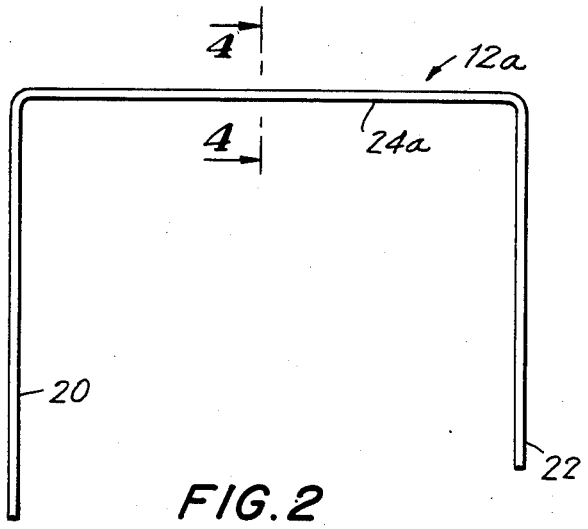
FIG. 2 is a side elevation view of a jack contact of a first set of jack contacts for use in the jack illustrated in FIG. 1.
Figure 4:
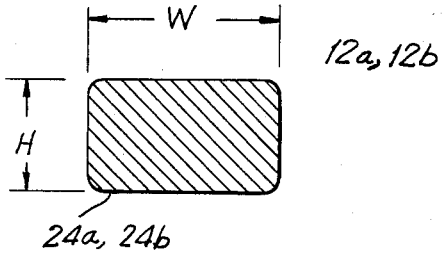
FIG. 4 is a section view taken along line 4—4 of FIG. 2.
Figure 3:
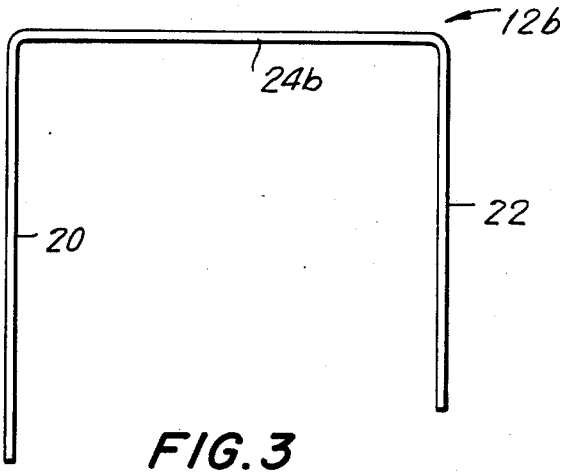
FIG. 3 is a view similar to FIG. 2 of a jack contact of a second set of jack contacts for use in the jack illustrated in FIG. 1.

The jack contacts 12 include a first set of first jack contacts 12*a* (FIGS. 2 and 4) and a second set of second jack contacts 12*b* (FIG. 3). Each jack contact 12*a*, 12*b*is formed of a suitable conductive material, such as phosphor bronze, and includes a pin portion 20, a contact portion 22, and a bridging portion 24*a*, 24*b* respectively. The first and second jack contacts 12*a* and 12*b* differ from each other in the length of their respective bridging portions 24*a* and 24*b* with bridging portions 24*b* being somewhat shorter than the bridging portion 24*a* as clearly seen in FIGS. 2 and 3.

Figure 15:
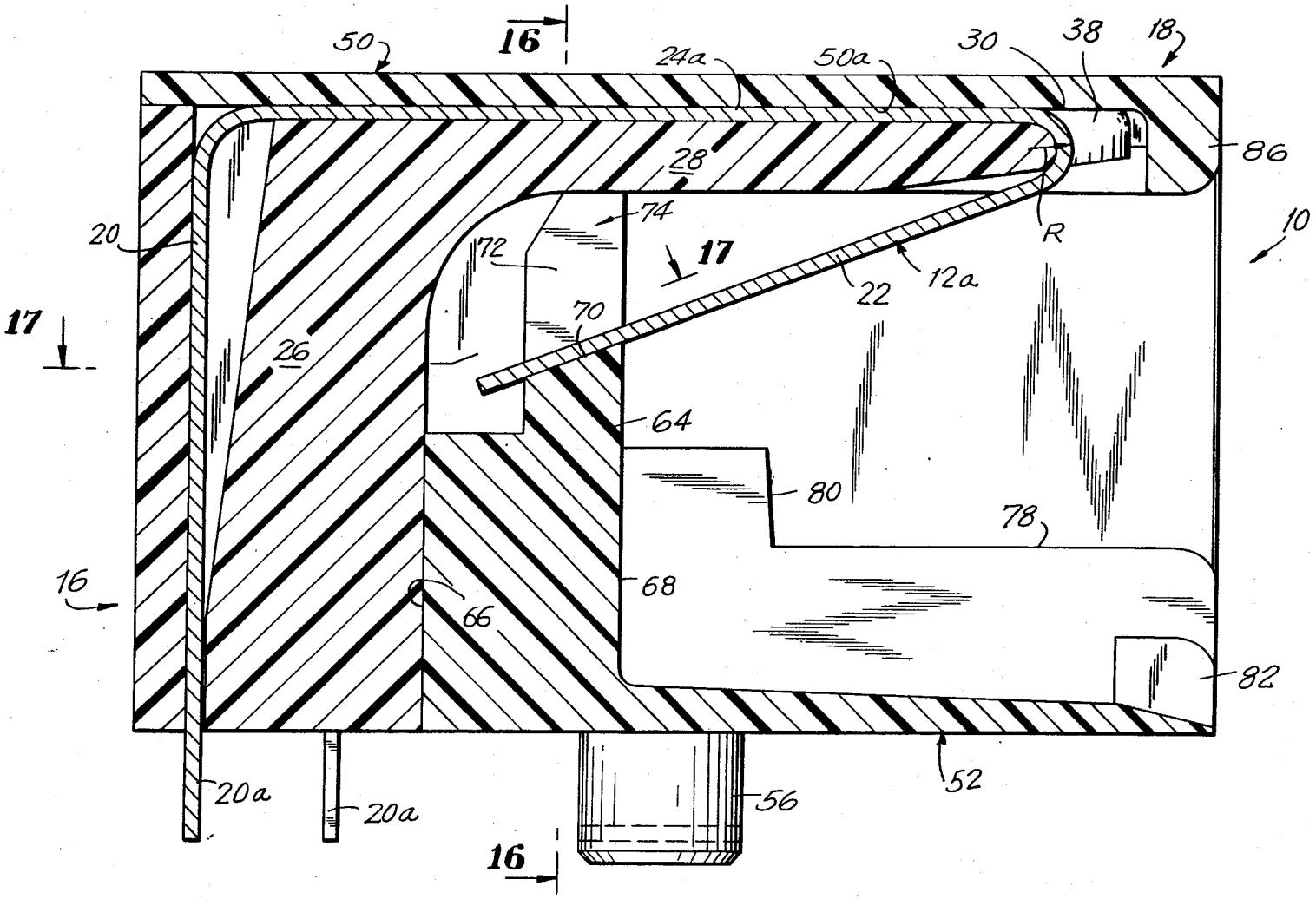
FIG. 15 is a longitudinal section view of the jack taken along line 15—15 of FIG. 1.

The jack contacts 12 are designed so as to be bendable into appropriate form with a minimal bend radius to facilitate the low profile construction of the jack while at the same time providing sufficient strength to ensure a high contact pressure between the jack and the plug contacts during use. In particular, it has been found that by forming the wire constituting the contacts 12 by a drawing operation to have the substantially rectangular cross-section shown in FIG. 4, the contacts 12 can be formed of a material having higher tensile strength than has been possible heretofore (thereby providing a higher contact pressure) while allowing the bend radius R (FIG. 15) to be smaller than had been possible heretofore (thereby facilitating the low profile construction of the jack) when the contacts were formed of the same high strength material by other forming operations, such as by stamping or photoetching. For example, when formed with the substantially rectangular cross-sectional configuration shown in FIG. 4 by a drawing operation, the wire of contacts 12 can be formed of 510 copper alloy phosphor bronze (5% phosphor) while still permitting the bend radius R to be less than that which could be obtained using wire having a round cross-section or rectangular cross-section formed by other operations, such as stamping or photoetching. In a preferred embodiment, the height H of the wire cross-section is about 0.012 inches while the width W is about 0.025 inches in the case of computer applications or about 0.018 inches in non-computer applications. The corners of the rectangular cross-section are preferably rounded with a radius of curvature of about 0.003 inches to avoid scraping the plastic material of the jack housing during construction as described below. The drawing operation also is advantageous in that no fins or burrs are formed which exist in the case of forming by photoetching or stamping. Such fins or burrs tend to break and separate from the contacts after assembly and may cause short circuits during operation. The surface smoothness of the contacts is also improved when the contacts are formed by drawing relative to the surface smoothness of contacts formed by other methods. For example, contacts formed by stamping typically have surface irregularities of a size between about 10–14 micro inches while the surface irregularities of the contacts formed by drawing are generally about 4 micro inches.

As noted above, the jack housing 14 is formed of two parts, namely, a first inner housing part 16 and a second outer housing part 18. The inner housing part 16 is inserted within the outer housing part 18 to be lockingly interfit therewith after pre-assembly of the contacts 12 with the inner housing part 16 to capture the contacts 12 between them, the contacts being completely enclosed within the housing and precisely located to engage corresponding plug contacts when the modular plug is inserted into the jack. At the same time, the contact portions 22 of the contacts 12 are automatically given a pre-stress during assembly to ensure a high pressure contact with the plug contacts.

The preferred embodiment of the jack illustrated herein includes six contacts. However, it is understood that the invention is not limited to a jack with six contacts, i.e., jacks with more or less than six contacts may be constructed in accordance with the invention.

Referring to FIGS. 5–10, the inner housing part 16 is formed of suitable plastic material and has an L-shaped configuration including a back portion 26 and a guide portion 28 extending from the top of the back portion 26 in a cantilever fashion. The back and guide portions 26 and 28 have a common coplanar top surface 30. A plurality of substantially vertical, parallel bores 32 are formed through the back portion 26, the number of bores 32 corresponding to the number of contacts 12. Each bore 32 extends throughout the entire height of the back portion 26 opening onto the top surface 30 and the bottom surface 34 thereof and has a downwardly tapering cross-section best seen in FIG. 7. Thus, each bore 32 is formed by a pair of downwardly converging side walls 32*a*, a vertical back wall 32*b*, and a front wall 32*c* which converges downwardly with respect to back wall 32*b*. The top end 32*d* of each bore opening onto top surface 30 has a cross-section substantially greater than the cross-section of each contact 12 while the bottom end 32*e* of each bore 32 opening onto the bottom surface 34 has a cross-section substantially corresponding to the cross-section of the contacts 12. The bottom bore ends 32*e* form a pattern which conforms to the socket pattern of the printed circuit board to which the jack is adapted to be connected. For example, the bores 32 are arranged in staggered forward and rearward rows 132 and 232 of three bores each, adjacent bottom ends 32*e* of bores 32 in each row being spaced from each other by a distance of 0.100 inches and the rows 132 and 232 being spaced from each other by a distance of 0.100 inches, a pattern commonly used in printed circuit boards. The length of the pin portions 22 of contacts 12 is greater than the length of bores 32 (i.e., the height of back portion 26) so that upon assembly of the jack as described below, a pin 22*a* of the contact projects below bottom surface 34 for connection to the printed circuit board.

A plurality of guide slots or channels 36 are formed in the top surface 30, each channel 36 opening at its rearward end at the top end 32*d* of a respective one of the bores 32. The channels 36 extend longitudinally over the guide portion 28 and terminate at forward edges 36*a* which are slightly recessed rearwardly of the forward edge 28*a* of the guide portion 28. At their forward edges 36*a*, the guide channels 36 are equi distantly spaced from each other by a spacing equal to the spacing between the plug contacts of the plug adapted to be used with the jack. Such spacing is commonly about 0.040 inches so that it is seen that the channels 36 slightly converge with each other in the forward direction. Tapered fingers 38 project forwardly from the guide portion 28 between the forward edges 36*a* of adjacent guide channels 36 so that each channel 36 communicates with a respective forwardly diverging space 40 (FIG. 6) separated from an adjacent one by a tapered finger 38.

Each channel 36 has a substantially rectangular cross-section (best seen in FIG. 16) with its width and height corresponding to the width and height of the jack contacts 12. The channels 36 communicating with the bores 32 of the forward row 132 have lengths substantially equal to the lengths of the bridging poritions 24*b* of second jack contacts 12*b* while the channels 36 communicating with the bores 32 of the rearward row 232 have lengths substantially equal to the lengths of the bridging portions 24*a* of the first jack contacts 12*a*.

Means are provided on the first inner housing part 16 for facilitating the assembly of the same to the second outer housing part 18 and locking the housing parts to each other. In particular, a pair of upper rails 42 are provided along the lateral sides of the guide portion 28 while a pair of lower rails 44 parallel to upper rails 42 are provided along the lateral sides of back portion 26. A pair of locking projections 46 are also formed on the lateral sides of back portion 26 above respective lower rails 44, each locking projection including a camming surface 46*a* and a rearwardly facing vertical locking surface 46*b*.

Referring now to FIGS. 5 and 11–14, the outer housing part 18 comprises a unitary member having a substantially rectangular parallelepiped shape formed by opposed top and bottom walls 50 and 52 and opposed side walls 54 defining an interior space between them. The inner and outer surfaces of the respective walls are designated by corresponding reference numerals followed by the suffixes "a" and "b" respectively. Bottom wall 52 has a rectangular cutout 53 which opens onto the rearward end 55 of housing part 18. A pair of posts 56 project downwardly from bottom wall 52 for connecting the jack to a printed circuit board. A pair of flanges 58 project laterally from side walls 54 for facilitating mounting of the jack to a chassis, if desired.

Figure 12:
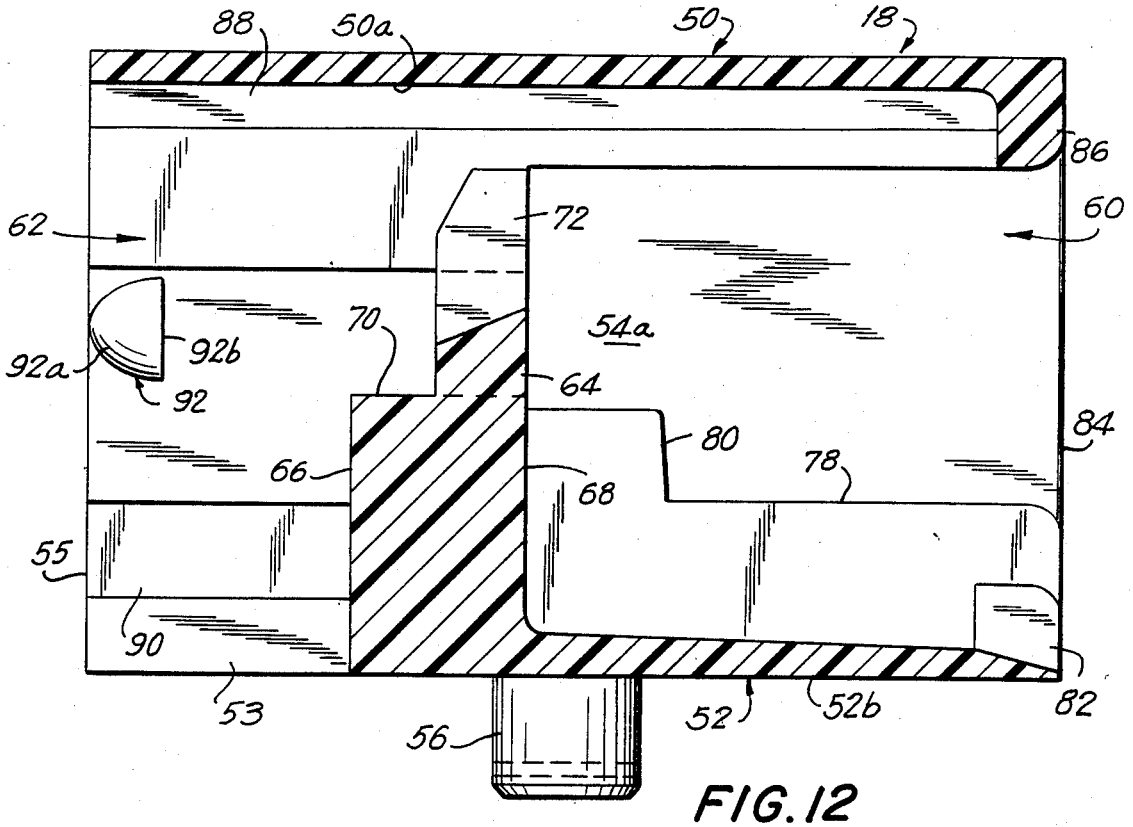
FIG. 12 is a section view taken along line 12—12 of FIG. 11.
Figure 13:
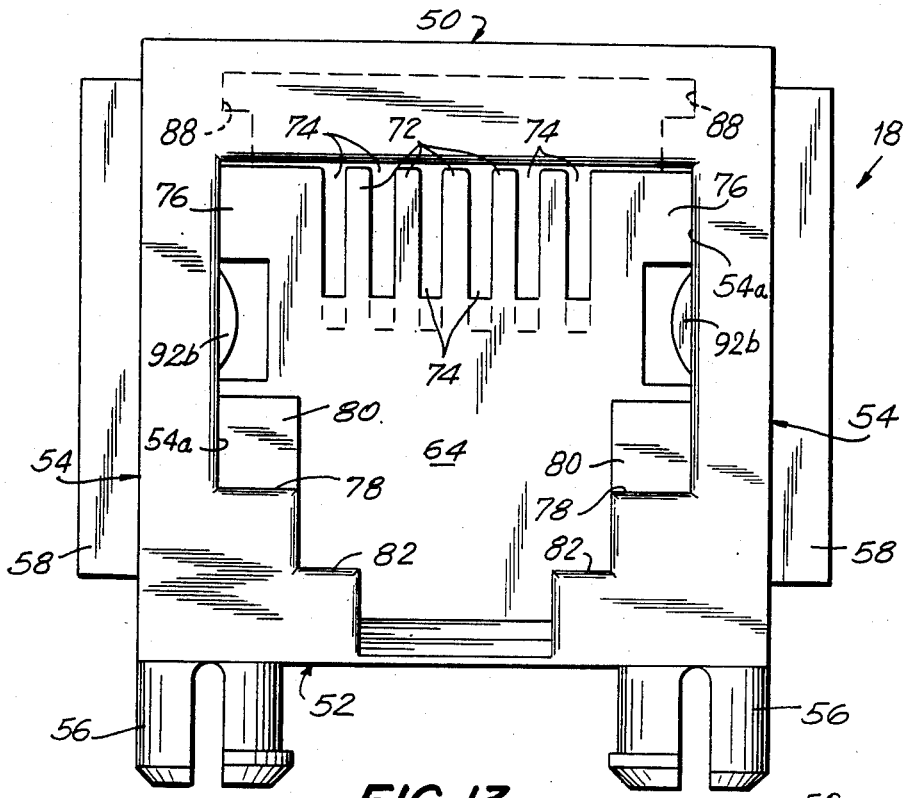
FIG. 13 is a front elevation view of the second outer housing part.
Figure 14:
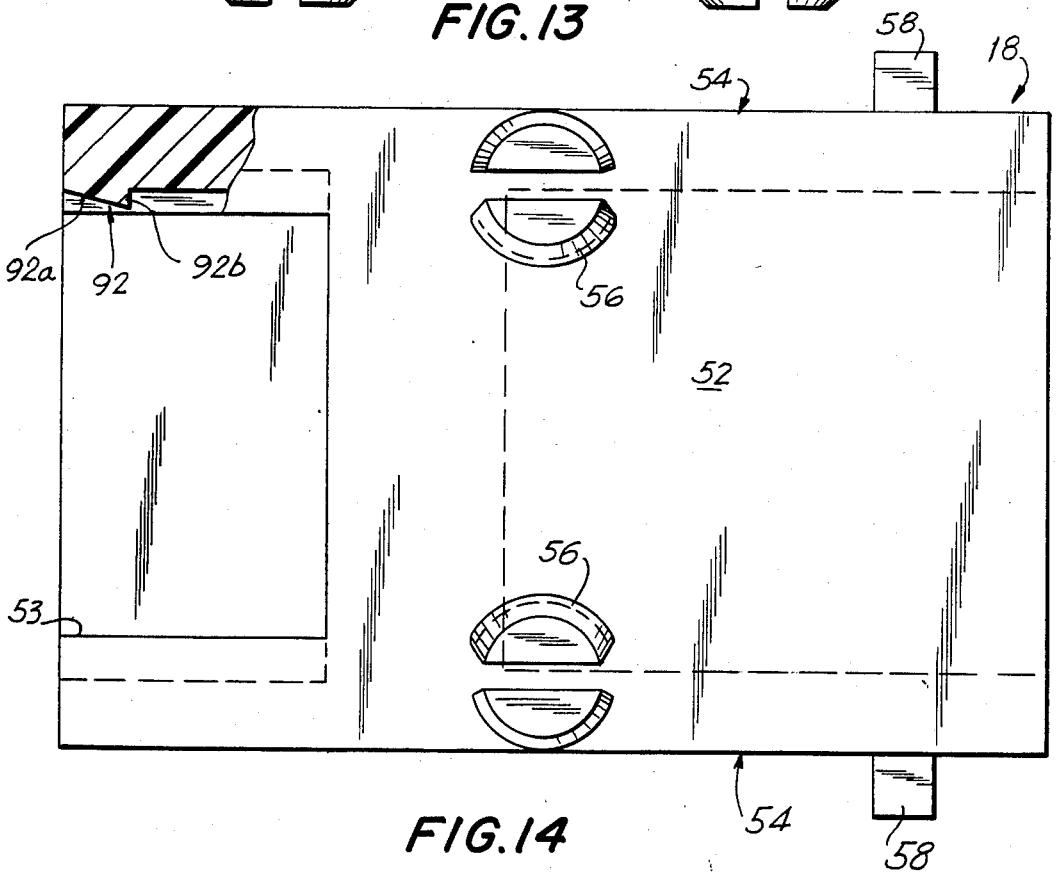
FIG. 14 is a bottom plan view of the second outer housing part.

The interior of the housing part 18 is divided by a wall 64 into a forward plug receptacle 60 and a rearward space 62 (FIG. 12) for receiving the back portion 26 of the inner housing part 16 with the guide portion 28 extending between both spaces 60 and 62. The wall 64 projects upwardly from bottom wall 52 and has a rear surface 66, a front surface 68 and a top surface 70 which is angled upwardly in the forward direction as best seen in FIG. 12. The distance between the rear surface 66 of wall 64 and the rear end 55 of housing part 18 is essentially equal to the longitudinal dimension of the back portion 26 of inner housing part 16. The distance between the plane of the outer surface 52*b* of bottom wall 52 and the inner surface 50*a* of top wall 50 is substantially equal to the height dimension of the inner housing part 16, i.e., the dimension between top and bottom surfaces 30 and 34. A comb-like structure comprising a plurality (five in the illustrated embodiment) of longitudinally extending, mutually spaced partitions 72 project upwardly from the top surface 70 of wall 64 and define a corresponding number (six in the illustrated embodiment) of guide slots 74 together with a pair of outermost walls 76 situated at respective lateral sides of the wall 64. Upon assembly of the jack, the guide slots 74 are aligned with the forward edges 36*a* of guide channels 36 of the inner housing part 16.

A pair of longitudinally extending shoulders 78 terminating at abutment surfaces 80 project inwardly from the inner surfaces 54*a* and side walls 54 within plug receptacle space 60 for engaging a conventional modular plug when the latter is inserted into the plug receptable space 60. In this connection, a pair of spaced lips 82 project upwardly from the bottom wall 52 at the plug receiving opening at the front end 84 of the outer housing part 18. These lips constitute locking surfaces for the locking tab of the modular plug as is conventional. A lip 86 projects downwardly from the top wall 50 at the front end 84 of housing part 18.

A pair of upper channels 88 are formed in the inner surfaces 54*a* of side walls 54 immediately below the top wall 50 for receiving the upper rails 42 of the guide portion 28 of inner housing part 16. Upper rails 42 extend from the rear end 55 of the outer housing part 18 to the inner side of lip 86 at the forward end 84 of housing part 18. A pair of lower channels 90 are formed in the inner surfaces 54*a* of side walls 54 extending from the rear housing part end 55 up to the rear surface 56 of separating wall 64. The lower channels 90 receive the lower rails 44 of inner housing part 16 upon assembly. A pair of locking projections 92 are formed on the inner surfaces 54*a* of side walls 54 and each include a camming surface 92*a* and a forwardly facing locking surface 92*b* adapted to lockingly engage the locking surfaces 46*b* of locking projections 46 upon assembly as described below.

Figure 5:
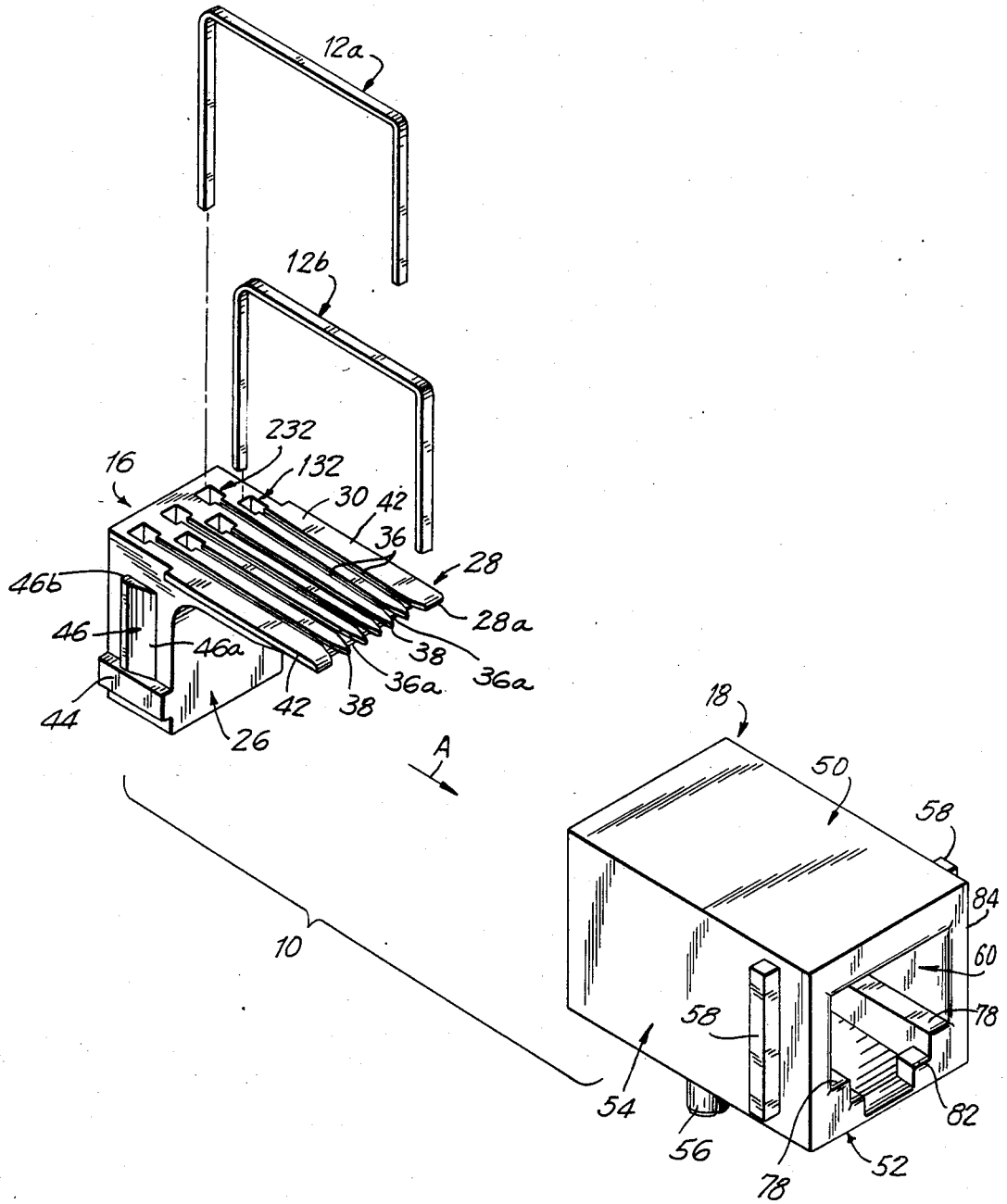
FIG. 5 is an exploded perspective view of the jack illustrated in FIG. 1 showing the two housing parts and the jack contacts.
Figure 6:
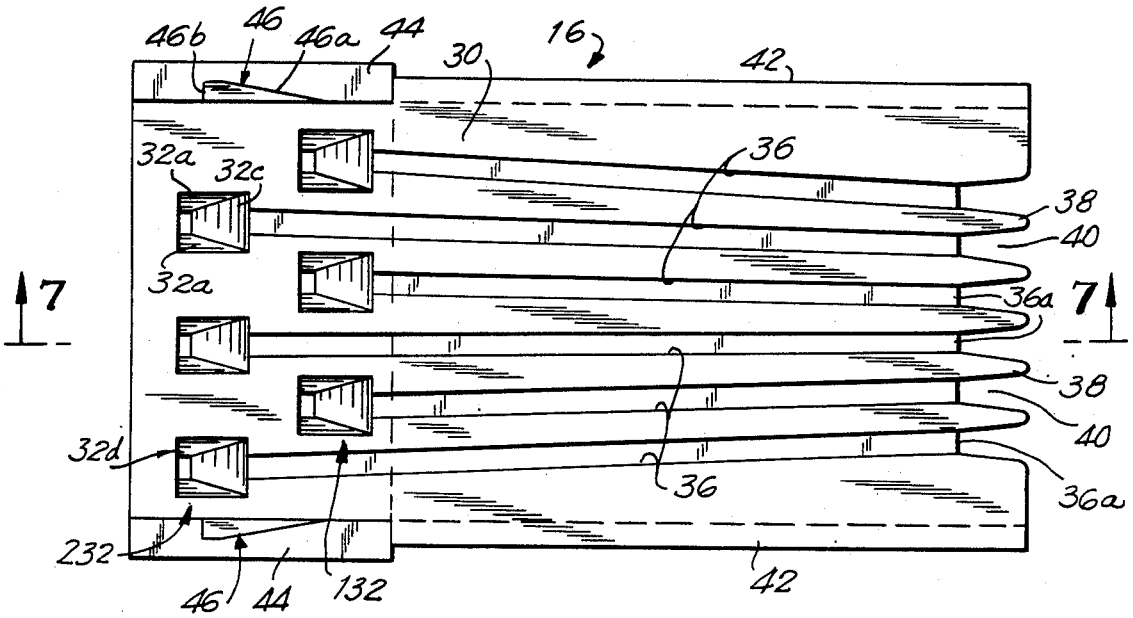
FIG. 6 is a top plan view of a first inner housing part of the jack housing.
Figure 7:
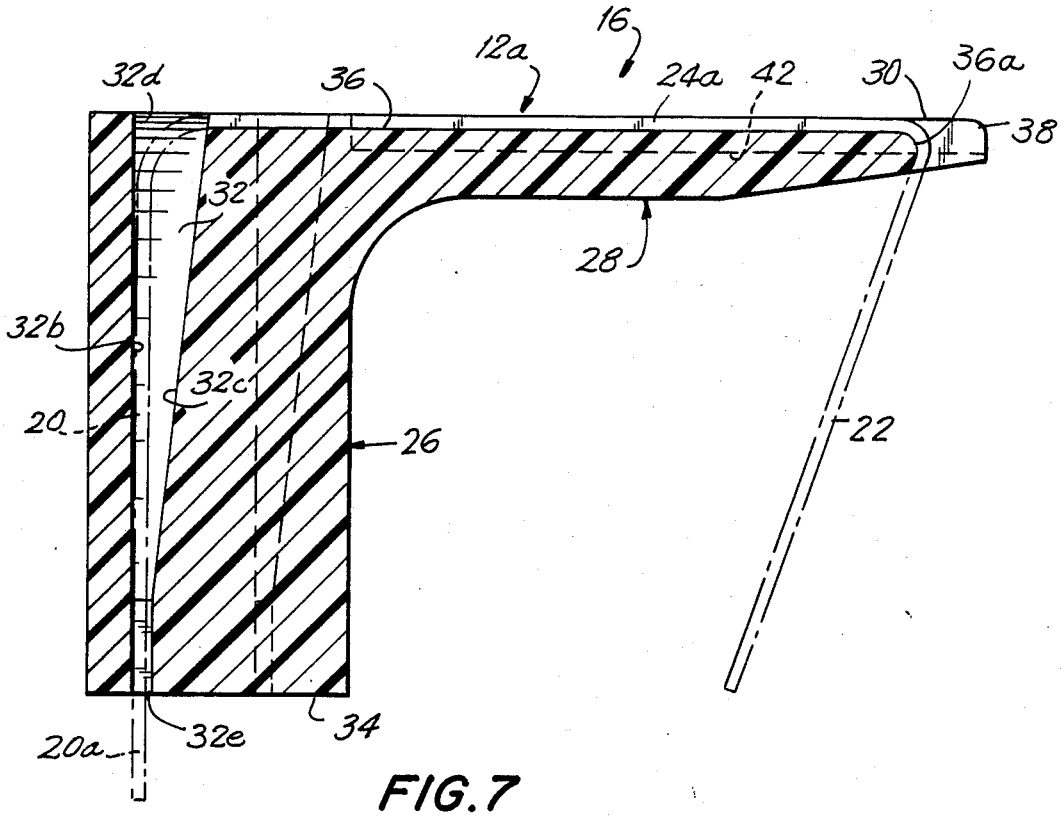
FIG. 7 is a section view taken along line 7—7 of FIG. 6 and illustrating one jack contact assembled to the inner housing part prior to final assembly.
Figure 8:
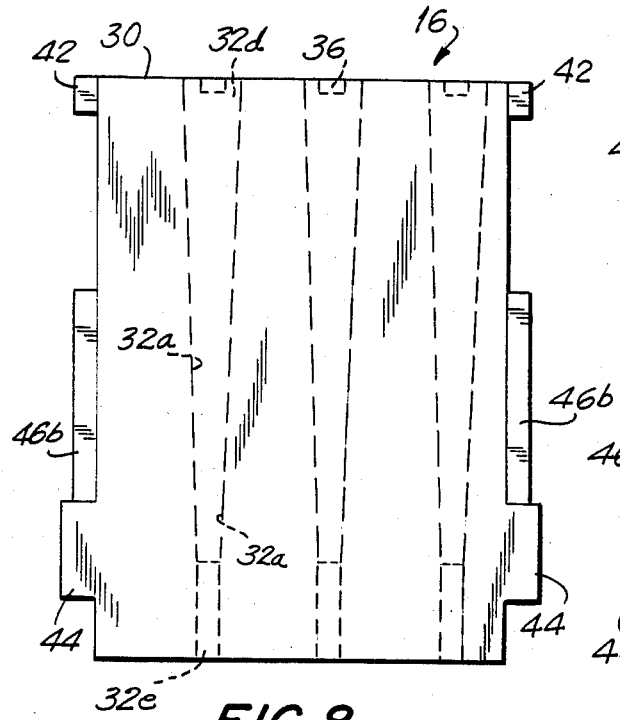
FIG. 8 is a rear elevation view of the first inner housing part illustrated in FIG. 6.
Figure 9:
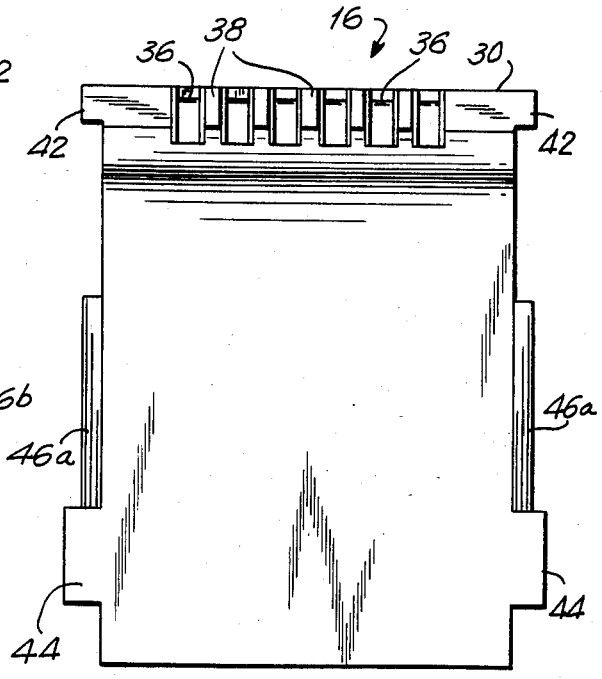
FIG. 9 is a front elevation view of the first inner housing part illustrated in FIG. 6.
Figure 10:
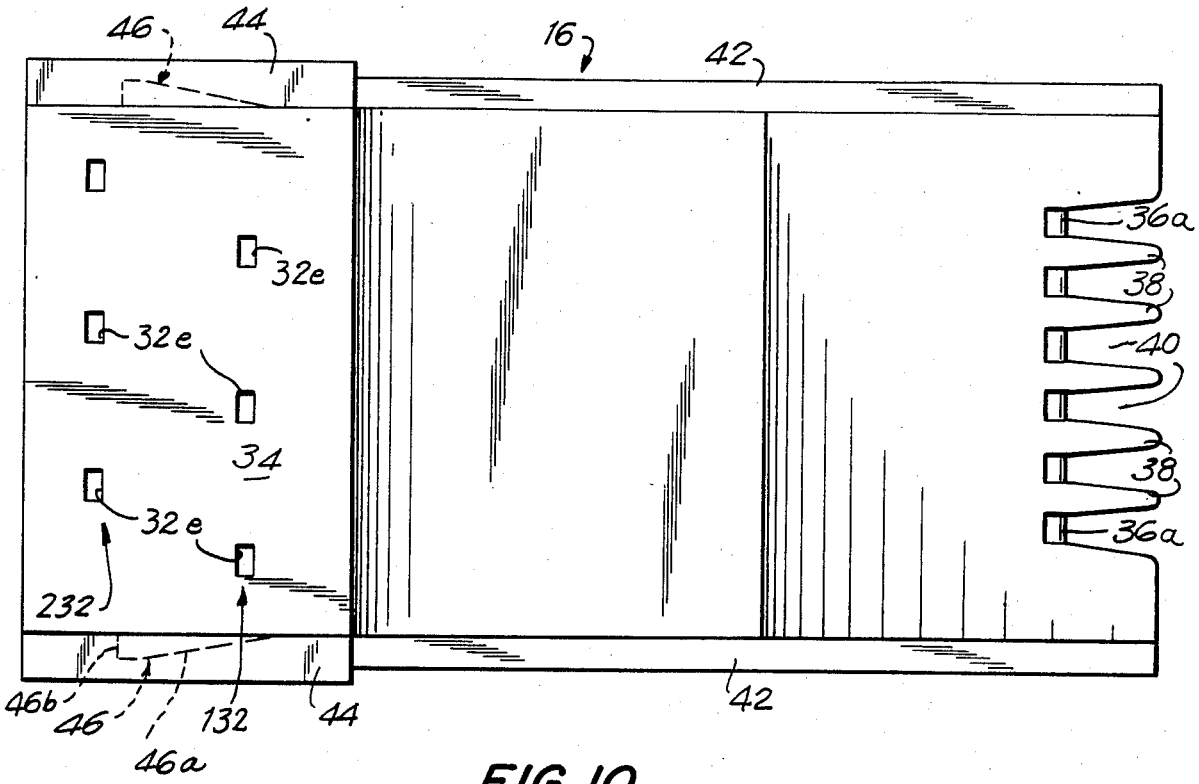
FIG. 10 is a bottom plan view of the first inner housing part illustrated in FIG. 6.
Figure 11:
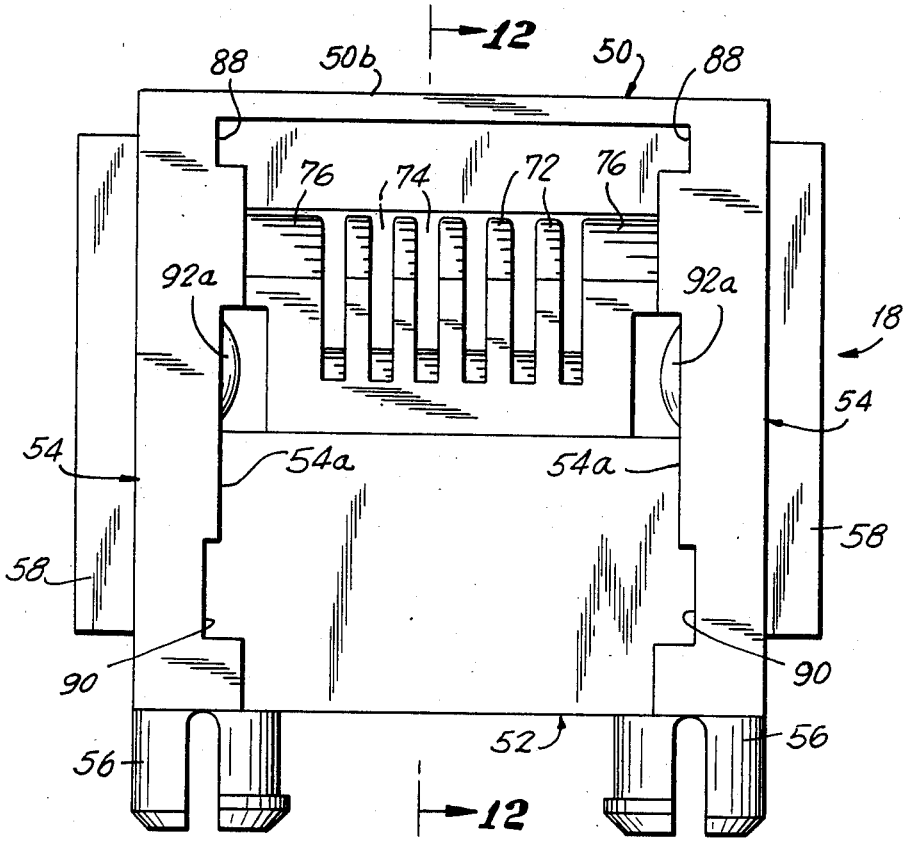
FIG. 11 is a rear elevation view of a second outer housing part of the jack housing.

Referring now to FIGS. 5, 7 and 15–17, the assembly of the jack 10 will now be described. The contacts 12*a* and 12*b* are associated with the inner housing part 16 as seen in FIGS. 5 and 7. Thus, the pin portions 20 of each of the first contacts 12*a* are inserted into the bores 32 of the rearward row 232 so that the pins 28 project below the bottom surface 34 of the back portion 26 and the bridging portions 24*a* are received in corresponding guide channels 36. Similarly, the pin portion 20 of each of the second contacts 12*b* are inserted into the bores 32 of the forward row 132 with bridging portions 24*b* received in corresponding guide channels 36. The contact portions 22 of the contacts 12 pass over the forward edges 36*a* guide channels 36 separated by fingers 38. Assembly of the contacts to the inner housing part is facilitated by the large top ends 32*d* of each bore 32 and the diverging spaces 40 at the forward ends of each guide channel. Each of the contact portions are preferably provided with a slight rearward pre-bend as shown in FIG. 7 to capture the contacts to the inner housing part. The dimensions of the guide channels 36 and contacts 12 are such that the exposed upper surfaces of the bridging portions 24 of the contacts are substantially flush with the upper surface 30 of the inner housing part 16.

Figure 16:
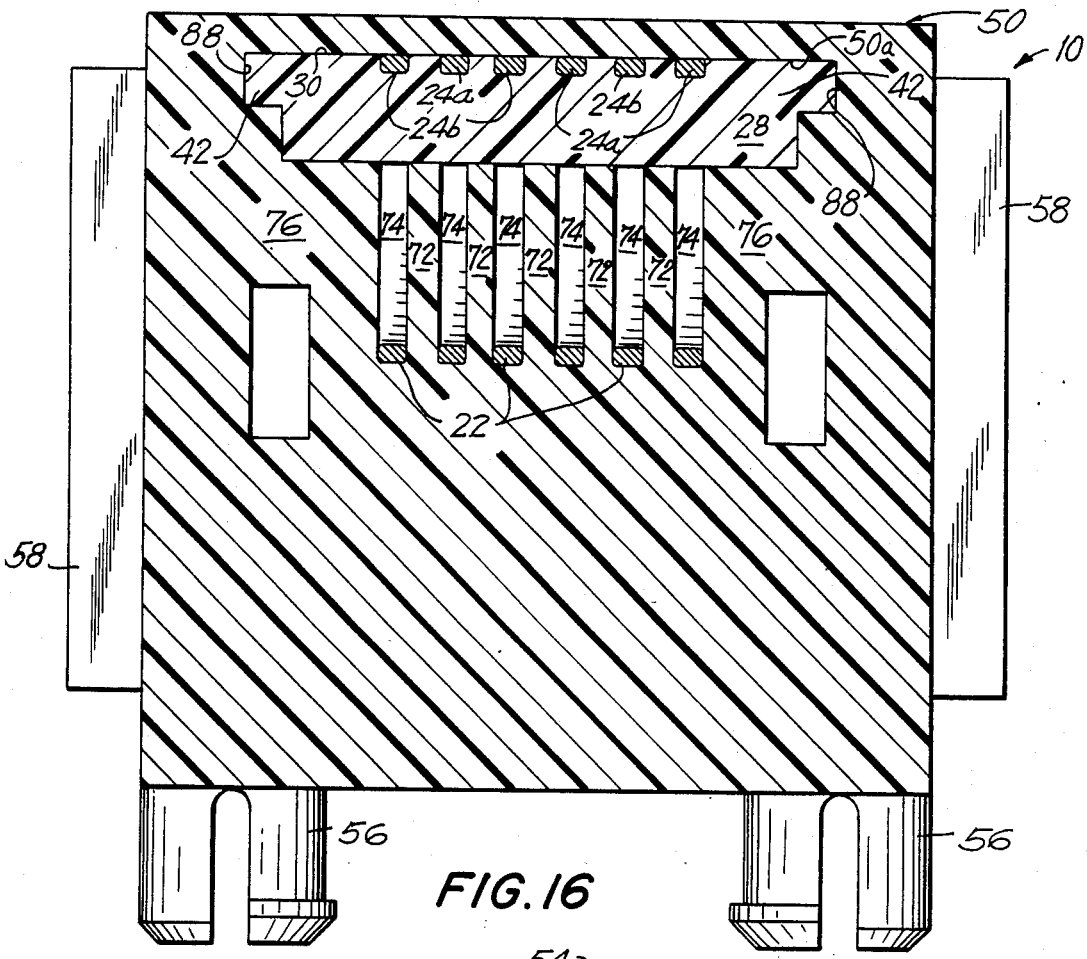
FIG. 16 is a section view taken along line 16—16 of FIG. 15.
Figure 17:
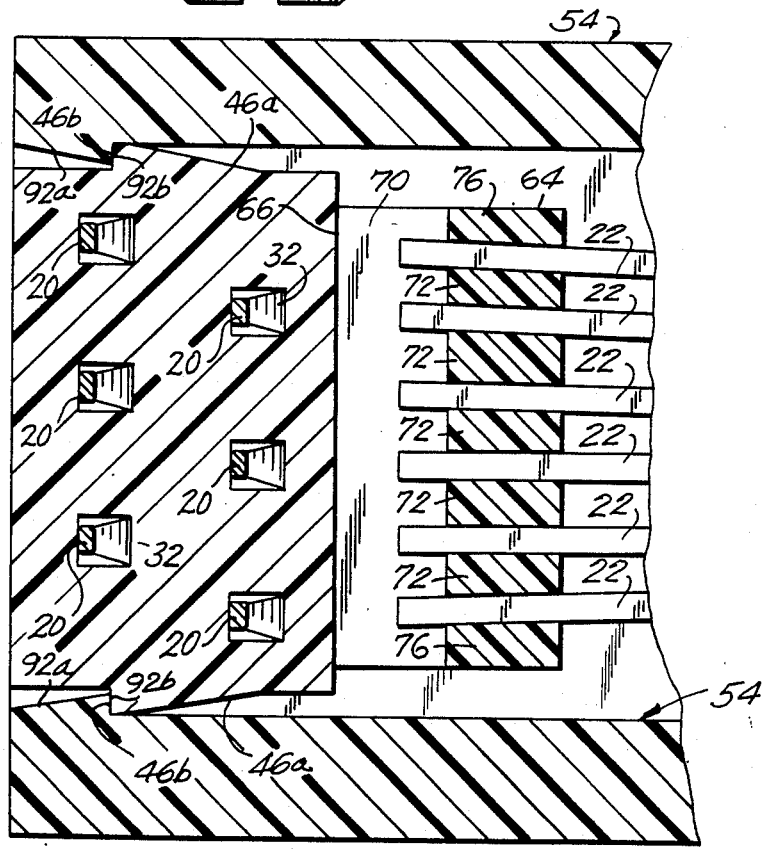
FIG. 17 is a partial section view taken along line 17—17 of FIG. 15.

The sub-assembly of the inner housing part 16 and contacts 12 is then inserted into the rearward space 62 within outer housing part 18 in the direction of arrow A of FIG. 5 with the upper and lower rails 42 and 44 being received in the upper and lower channels 88 and 90. During insertion, the contact portions 22 are aligned with respective ones of the guide slots 74 formed between partition 72 and engage a rounded surface interconnecting the rear and top surfaces 66 and 70 of wall 64 whereby the contact portions 22 and automatically eventually deformed into the shape shown in FIG. 15. When insertion is completed, the end region of each contact bears with a spring force or pre-stress against the top surface 70 of separating wall 64 in its own respective guide slot 74. Partitions 72 prevent the contacts 12 from contacting each other during operation. The inner surface 50*a* of the top wall 50 of the outer housing part 18 bears against the top surface 30 of inner housing part 16 and the top surfaces of the bridging portions 24 of contacts 12 within guide channels 36 as best seen in FIG. 16 thereby fixing the contacts in place. During insertion, the camming surfaces 46*a*, 96*a*, of locking projections 46, 96 engage each other until the locking surfaces 46*b*, 96*b* snap into engagement as best seen in FIG. 17 whereupon the inner and outer housing parts become locked to each other. The longitudinal dimension of the back portion 26 of inner housing part 16 is such that its rear surface is flush with the rear end of the outer housing part 18 when insertion has been completed.

By forming the contacts 12 of flat wire in the manner described above, the radius of curvature R (FIG. 15) can be made sufficiently small (with the contacts 12 still being formed of high strength material) that the overall height of the jack can be small sufficiently small that the jack can be accommodated in very small spaces. The jack construction is provided with the further advantage that the contacts 12 are completely enclosed within the jack housing and can be formed of high strength material so that a high contact pressure is provided with the plug contacts to ensure a reliable electrical connection. Shorting of the jack contacts cannot occur due to the separation of the guide slots 24 by partitions 72. All of these features are accomplished with a relatively simple two-part construction of the jack housing.

Obviously, numerous modifications and variations of the present invention are possible in the light of the above teachings. It is therefore to be understood that within the scope of the claims appended hereto, the invention may be practiced otherwise than as specifically disclosed herein.

What is claimed is:

1. A self-contained modular jack for a modular plug adapted for connection to a printed circuit board, comprising:

a two-part housing including an outer housing part and an inner housing affixed thereto;

said outer housing part comprising a unitary member formed by opposed top and bottom walls and opposed side walls, said top, bottom and side walls being integally formed and defining an interior longitudinally extending space between them, a partition wall extending transversely through said said space substantially between said opposed side walls, said partition wall projecting upwardly and dividing said longitudinal space into a forward plug receptacle space bounded by said top, bottom and side walls, and a rearward space, said partition wall terminating in a series of upwardly projecting spaced partitions defining a series of guide slots between them, and having ends defining a gap with said top wall that extends transversely substantially between said opposed side walls;

said inner housing part comprising a substantially L-shaped unitary member fixed to said outer housing part, said L-shaped member including an upwardly extending back portion and a longitudinally extending guide portion projecting from an upper region of said back portion, said back portion situated in said rearward space of said outer housing part and said guide portion extending from said rearward space into said forward plug receptacle space of said outer housing part through said gap defined between said ends of said partitions and said top wall of said outer housing part; and said jack further including a plurality of jack contacts, each of said jack contacts including a pin portion, a contact portion and a bridging portion interconnecting said pin and contact portions, said bridging portions extending longitudinally on a top surface of said guide portion of said inner housing part between said guide portion and said top wall of said outer housing part and from said back portion to a forward end region of said guide portion, said contact portions extending from said forward end region of said guide portion into respective ones of said guide slots of said outer housing part, and said pin portion extending downwardly at said back portion and having ends adapted to be connected to a printed circuit board.

2. The combination of claim 1 wherein said contacts are formed of flat wire manufactured by a drawing operation having a substantially rectangular cross-section, and wherein said contact and bridging portions of each contact are bent with respect to each other around a curved contact portion having a minimal radius of curvature.

3. The combination of claim 1 wherein a plurality of bores are formed through said back portion for receiving said pin portions of said contacts, and a plurality of guide channels are formed in a top surface of said guide portion, each guide channel opening at a rearward end thereof into a top end of a respective one of said bores for receiving said bridging portion of a respective one of said contacts.

4. The combination of claim 3 wherein each of said bores formed through said back portion taper in a downward direction.

5. The combination of claim 3 wherein each guide channel terminates at a forward end thereof in the region of a forward edge of said guide portion.

6. The combination of claim 5 wherein fingers project forwardly from said forward edge of said guide portion, each finger being situated between the forward ends of adjacent guide channels.

7. The combination of claim 5 wherein said guide channels at least slightly converge in the forward direction.

8. The combination of claim 1 wherein said guide portion of said inner housing part has a top surface in which a plurality of guide channels are formed, each guide channel receiving a bridging portion of a respective one of said contacts with an exposed surface of said contacts being substantially flush with said top surface of said guide portion, and wherein said inner housing part is fixed within said outer housing part such that said inner surface of said top wall of said outer housing part contiguously overlies said top surface of said guide portion and said exposed surface of said contact bridging portion.

9. The combination of claim 8 wherein a plurality of bores are formed through said back portion of said inner housing part for receiving said pin portions of said contacts, and wherein each guide channel opens into a top end of a respective one of said bores.

10. The combination of claim 9 further including cooperating rail and channel means formed on said inner and outer housing parts for positioning said housing parts with respect to each other.

11. The combination of claim 1 wherein said contacts are formed of flat wire having a substantially rectangular cross-section.

12. The combination of claim 11 wherein said flat wire of which said contacts are formed is manufactured by a drawing operation.

13. A jack for modular plugs adapted for connection to printed circuit boards, comprising:

a two-part housing including an outer housing part and an inner housing part received within said outer housing part and a plurality of jack contacts;

each of said jack contacts including a pin portion, a contact portion and a bridging portion interconnecting the same;

said inner housing part including a top wall having a top surface over which said contact bridging portions extend; and said outer housing part having a top wall contiguously overlying said top surface of said top wall of said inner housing part over which said bridging portions of said contacts extend.

14. The combination of claim 13 further including a contact separator wall integral with said outer housing part and extending through said jack housing, a plurality of spaced partitions projecting from a top surface of said separator wall forming guide slots between them, and wherein said contact portion of each of said jack contacts extends from a forward end of said top surface of said top wall of said inner housing part into a respective one of said guide slots.

15. The combination of claim 13 wherein said outer housing part includes top, bottom and side walls having respective inner surfaces defining an interior space between them, and wherein said inner housing part comprises a substantially L-shaped member including said top wall and a back wall.

16. The combination of claim 15 wherein means are provided on said top surface of said top wall of said inner housing part for maintaining said bridging portions of said contacts in mutually spaced relationship.

17. The combination of claim 16 further including a contact separator wall extending through said jack housing having ends affixed to said inner surfaces of said side walls of said outer housing part, a plurality of spaced partitions projecting from said separator wall forming guide slots between them, and wherein said contact portions of each of said jack contacts extends from a forward end of said top surface of said top wall of said inner housing part into a respective one of said guide slots.

* * * * *

US004703991B1

REEXAMINATION CERTIFICATE (3190th)

United States Patent [19]

Philippson

[11] B1 4,703,991

[45] Certificate Issued May 13, 1997

[54] LOW PROFILE JACK

[75] Inventor: Walter M. Philippson, Woodside, N.Y.

[73] Assignee: Stewart Connector Systems, Inc., Glen Rock, Pa.

Reexamination Request:
No. 90/004,139, Feb. 14, 1996

Reexamination Certificate for:

| | |
|---|---|
| Patent No.: | **4,703,991** |
| Issued: | **Nov. 3, 1987** |
| Appl. No.: | **817,816** |
| Filed: | **Jan. 10, 1986** |

[51] Int. Cl.[6] ..... H01R 23/02

[52] U.S. Cl. ..... 439/676; 439/76; 439/752

[58] Field of Search ..... 439/676, 741, 439/374, 59, 62, 78, 79

[56] References Cited

U.S. PATENT DOCUMENTS

| | | | |
|---|---|---|---|
| T958,009 | 5/1977 | Snyder | 339/99 R |
| T961,003 | 8/1977 | Krumreich | 339/176 M |
| 3,850,497 | 11/1974 | Krumreich et al. | 339/126 R |
| 3,990,764 | 11/1976 | Krumreich | 339/176 M |
| 4,202,593 | 5/1980 | Abernethy et al. | 339/125 R |
| 4,210,376 | 7/1980 | Hughes et al. | 339/17 LC |
| 4,224,485 | 9/1980 | Krumreich | 200/51.1 |
| 4,261,633 | 4/1981 | Abernethy | 339/97 P |
| 4,274,691 | 6/1981 | Abernethy et al. | 339/19 |
| 4,327,958 | 5/1982 | Hughes et al. | 339/276 SF |
| 4,444,451 | 4/1984 | Myers | 339/154 A |
| 4,457,570 | 7/1984 | Bogese, II | 339/17 C |
| 4,618,207 | 10/1986 | Silbernagel | 339/176 M |
| 4,699,443 | 10/1987 | Goodrich et al. | 439/188 |

OTHER PUBLICATIONS

"Printed Wiring Board Modular Jack", Western Electric Technical Digest, No. 74, Goodrich et al., Jul., 1984.

*Primary Examiner*—David Pirlot

[57] ABSTRACT

A jack for modular plugs adapted for connection to printed circuit boards. The jack includes a plurality of jack contacts and a two-part housing, the contacts and housing parts being constructed so that the contacts are preferably completely enclosed within the housing with the jack at the same time having a low profile, i.e., a small height dimension.

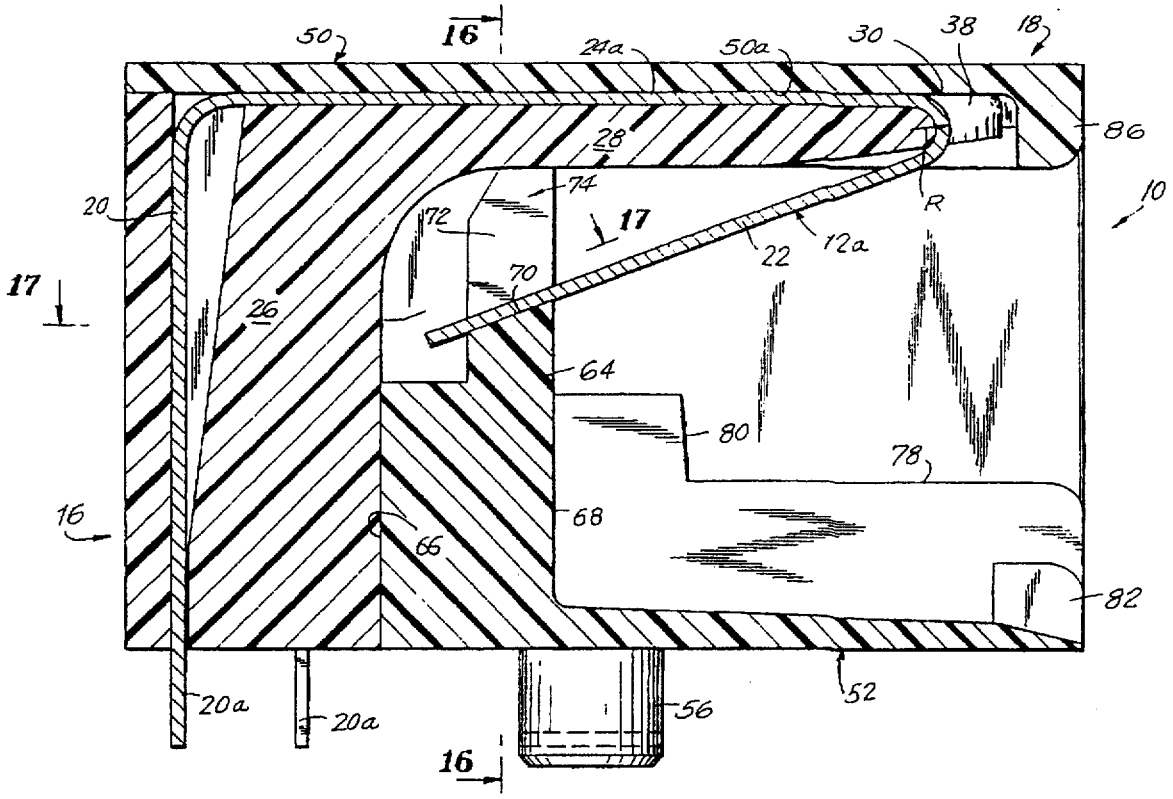

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 9 and 10 is confirmed.

Claims 1, 2, 8 and 11–17 are cancelled.

Claim 3 is determined to be patentable as amended.

Claims 4–7, dependent on an amended claim, are determined to be patentable.

New claim 18 is added and determined to be patentable.

3. The combination of claim 1 wherein a plurality of bores are formed through said back portion for receiving said pin portions of said contacts, and a plurality of guide channels are formed *solely* in a top surface of said guide portion, each guide channel opening at a rearward end thereof into a top end of a respective one of said bores for receiving said bridging portion of a respective one of said contacts.

*18. The combination of claim 3 wherein,*

*said bottom wall of said outer housing part has a bottom surface;*

*said back portion of said inner housing part has top and bottom surfaces;*

*said bottom surface of said back portion of said inner housing part is coplanar with said bottom surface of said bottom wall of said outer housing part;*

*said guide portion of said inner housing part has a top surface coplanar with said top surface of said back portion; and*

*said plurality of bores formed through said back portion of said inner housing part are fully closed along their length, each having a top end which opens onto said top surface of said back portion and a bottom end which opens onto said bottom surface of said back portion.*

* * * * *